US007793717B2

(12) United States Patent
Davison

(10) Patent No.: US 7,793,717 B2
(45) Date of Patent: Sep. 14, 2010

(54) PROGRESSIVE CAVITY PUMP ROD GUIDE

(75) Inventor: Matthew S. Davison, Oklahoma City, OK (US)

(73) Assignee: Robbins & Myers Energy Systems L.P., Willis, TX (US)

( * ) Notice: Subject to any disclaimer, the term of this patent is extended or adjusted under 35 U.S.C. 154(b) by 201 days.

(21) Appl. No.: 12/005,446

(22) Filed: Dec. 27, 2007

(65) Prior Publication Data

US 2009/0166036 A1 Jul. 2, 2009

(51) Int. Cl.
*E21B 17/10* (2006.01)

(52) U.S. Cl. ..... 166/241.4; 166/241.1; 166/241.2; 175/325.5

(58) Field of Classification Search ..... 166/241.4, 166/241.1, 241.2, 241.6; 175/325.1, 325.5
See application file for complete search history.

(56) References Cited

U.S. PATENT DOCUMENTS 4,343,518 A 8/1982 Pourchot
5,191,938 A 3/1993 Sable et al.
5,339,896 A 8/1994 Hart et al.
5,740,862 A 4/1998 Sable
5,755,284 A 5/1998 Hart et al.
5,873,157 A 2/1999 Hart et al.

*Primary Examiner*—Kenneth Thompson
*Assistant Examiner*—Sean D Andrish
(74) *Attorney, Agent, or Firm*—Browning Bushman P.C.

(57) ABSTRACT

A rod guide is provided for use in a rotating rod string (12) for powering a progressive cavity pump (14) for pumping downhole fluids through tubing (16) to the surface. The rod guide includes a rotor sleeve (20) secured to the rod string and having a plurality of circumferentially spaced exterior surfaces (22) each positioned substantially along an exterior of a cylinder. The rotor sleeve also includes one or more stop surfaces (24) for limiting axial movement of a stator sleeve (40) with respect to the rotor sleeve, and two or more axially extending cavities (26) each extending from a bottommost surface to an opposing uppermost surface of the rotor sleeve and passing through the one or more stop surfaces. Stator sleeve (40) surrounds the rotor sleeve and has an interior surface (42) for engaging the plurality of circumferentially spaced exterior surfaces of the rotor sleeve, and a plurality of ribs (44) extending outward from two or more outer cylindrical surface portions (44) of the stator sleeve.

20 Claims, 1 Drawing Sheet

PROGRESSIVE CAVITY PUMP ROD GUIDE

FIELD OF THE INVENTION

The present invention relates to a rod guide of a type suitable for guiding a sucker rod within production tubing of an oil or gas well. More particularly, the invention relates to a rod guide for guiding a rotary sucker rod which powers a progressive cavity (PC) pump in a well.

BACKGROUND OF THE INVENTION

Various types of rod guides have been devised for guiding a sucker within production tubing. Many rod guides are intended for use with a reciprocating sucker rod, and other rod guides are primarily intended for use with a rotating sucker rod. Some guides have utility for either a reciprocating rod or a rotating rod, although design considerations generally dictate that a sucker rod guide be primarily intended for one application.

Compared to commonly used beam pumps which are powered by a reciprocating sucker rod, progressive cavity pumps are generally able to deal with a high concentration of sand or other particulate in the recovered fluid. In many cases, however, rod guides for PC pumps wear excessively when subjected to the upwardly moving fluid and sand within the production tubing. The cost of replacing PC rod guides for these applications thus represents a significant cost to the well operator. Other rod guides have low erodeable wear volume, i.e., the volume of the guide radially exterior of the rod coupling is minimal, and wear of that excess material reduces the purpose of the guide. Other rod guides have poor flow characteristics, meaning that the flow channels around the guide result in a high pressure loss, thereby increasing the power required to pump the fluids to the surface. Other types of rod guides allow sand or other particles to become trapped or imbedded between components of the guide, thereby substantially contributing to premature wear of the guide.

The disadvantages of the prior art are overcome by the present invention, and an improved rod guide particularly suited for a progressive cavity pump is hereinafter disclosed.

SUMMARY OF THE INVENTION

In one embodiment, a rod guide for use in a rotating rod string for powering a progressive cavity pump for pumping downhole fluids to the surface includes a rotor sleeve and a stator sleeve. The rotor sleeve is secured to the rod guide, and includes a plurality of circumferentially spaced exterior surfaces each positioned substantially along an exterior of a cylinder having an axis aligned with an axis of the rod string. The rotor sleeve also has one or more stop surfaces for limiting axial movement of the stator sleeve with respect to the rotor sleeve, and has two or more axially extending cavities each radially inward of and spaced circumferentially between two exterior surfaces of the rotor sleeve. Each cavity extends from a bottommost surface to an uppermost surface of the rotor sleeve and passes through the one or more stop surfaces for fluid flow between the rotor sleeve and the stator sleeve.

The stator sleeve surrounds the rotor sleeve and has an interior surface for engaging the plurality of circumferentially spaced exterior surfaces of the rotor sleeve. The stator sleeve has a plurality of ribs extending outward from two or more outer cylindrical surface portions of the stator sleeve, such that fluid passes between the outer cylindrical surface portions and the production tubing and between the plurality of ribs.

According to one embodiment of a method of the invention, the rotor sleeve is secured to the rod string and includes the plurality of circumferentially spaced exterior surfaces, each positioned substantially along an exterior of the cylinder. The method includes providing one or more stop surfaces on the rotor sleeve for limiting axial movement of the stator sleeve with respect to the rotor sleeve, and providing two or more axially extending cavities on the rotor sleeve each radially inward of and spaced circumferentially between two exterior surfaces of the rotor sleeve. The method further includes positioning the stator sleeve about the rotor sleeve, with the stator sleeve having an interior surface for engaging a plurality of circumferentially spaced exterior surfaces of the rotor sleeve. The stator sleeve includes a plurality of ribs extending outward from two or more outer cylindrical surface portions of the stator sleeve, such that fluid passes between the outer cylindrical surface portions and the production tubing and between the plurality of ribs. The method includes rotating the rod string and the rotor sleeve to power a progressive cavity pump while pumping fluid through tubing surrounding the rod string and past the rod guide to the surface.

It is a feature of the present invention to provide a rod guide for guiding a rotating sucker rod which, for many applications, will have significantly reduced wear compared to conventional rod guides for rotating sucker rods. A related feature of the invention is to provide a rod guide with a rotor secured to the rod and a stator for positioning about the rod, with the rotor including a plurality of flow channels inward of an outer cylindrical-shaped exterior surface of the rotor, with the flow channels passing fluid between the stator and the rotor.

These and further features and advantages of the present invention will become apparent from the following detailed description, wherein reference is made to the figures in the accompanying drawings.

DETAILED DESCRIPTION OF PREFERRED EMBODIMENTS

Figure 1:
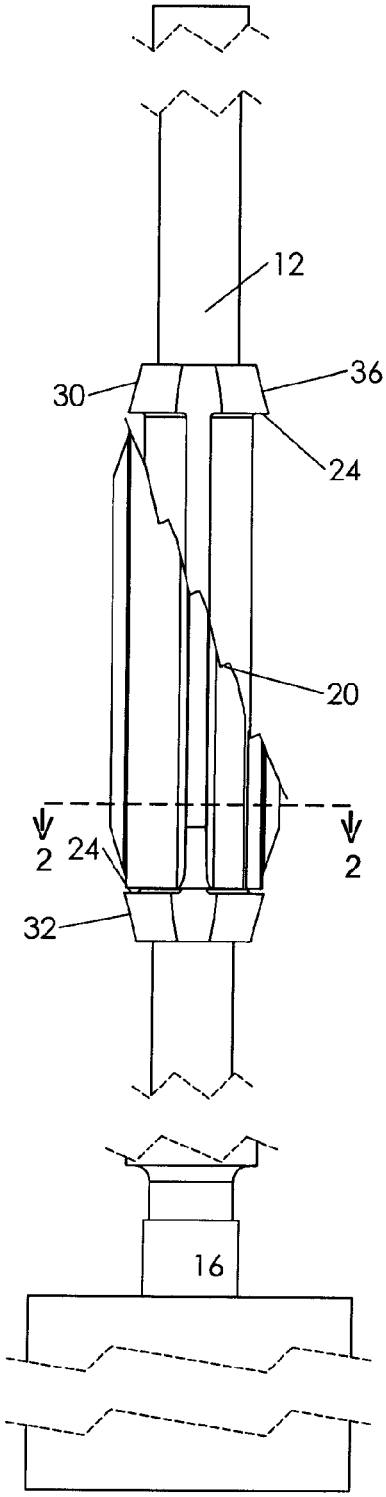
FIG. 1 illustrates a rotor sleeve molded on to a sucker rod, and a portion of a rotor sleeve on the stator sleeve.

FIG. 1 illustrates one embodiment of a rotor secured to a rotating rod string 12 which, as conceptually shown, powers a downhole progressive cavity pump 16 in a well. As shown more clearly in FIG. 2, the rotor sleeve includes a plurality of circumferentially spaced exterior surfaces 22 each positioned substantially along an exterior of an imaginary cylinder having an axis 28 substantially aligned with an axis of the rod string. The rotor sleeve 20 preferably is secured to the sucker rod 12 by a molding operation, and preferably is of a unitary and substantially homogeneous construction to provide the desired rigidity when used in hostile environments. Sleeve 20 is referred to as a "rotor" sleeve since, during operation, it is rotating with the rod string. Stator 40 discussed subsequently is positioned about the rotor sleeve, and preferably has a plurality of ribs, one or more of which conventionally engage the interior of a production tubing string. The stator sleeve 40 is not necessary static in a well, but may rotate at a slower speed than the rotor, or may not rotate, or may rotate during brief intervals in response to the rotating sucker rod, the well conditions, and the rod guide conditions.

The rotor sleeve 20 includes one or more stop surfaces 24 which limit axial movement of the stator sleeve with respect to the rotor sleeve. The upper and lower ends of the rotor sleeve 20 thus include an upper end cap 30 and a lower end cap 32, each of which have a frustroconical outer surface 36. The tapering of the end caps 30, 32 minimizes frictional losses when fluid passes by the rotor, while the stop surfaces 24 maintain the stator sleeve in position on the rotor sleeve between the stop surfaces 24.

Figure 2:
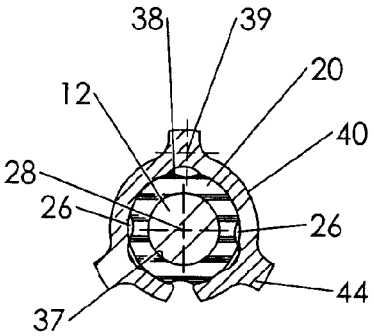
FIG. 2 is a cross section of the rotor sleeve and stator sleeve taken through plane 2-2 in FIG. 1.

As shown more clearly in FIG. 2, rotor sleeve 20 includes two or more axially extending cavities 26 which are each radially inward of and spaced circumferentially between two adjacent stop surfaces 24 on the rotor sleeve. Moreover, each cavity 26 preferably extends from a bottommost surface to an opposing uppermost surface of the rotor sleeve, and passes through the one or more stop surfaces 24 to form a continuation flow path 27 in the end caps 30, 32 for fluid flow in these cavities between the rotor sleeve and the stator sleeve.

More particularly, each of the axially extending cavities 26 has an exterior surface 38 formed by the arc of a circle or other ellipse having a center 39, as shown in FIG. 2. In many applications, center 39 of each arc segment 38 will lie substantially along the circumference of the imaginary cylinder which forms the surfaces 22. For the embodiment as shown in FIG. 2, four axially extending exterior surfaces are provided, and it is a feature that three or more exterior surfaces be provided circumferentially about the rotor sleeve. Each of the axially extending cavities 26 preferably has a radial depth from the arc center 39 which is at least 60%, and preferably is at least 70%, of the radial spacing between arc center 39 and the inner cylindrical surface 37 of the rotor sleeve, which is substantially the outer diameter of the sucker rod 12. A plurality of flow channels each with a sizable cross section area is provided, and this cross section flow area preferably is substantially constant from a lowermost end to an uppermost end of the rod guide. Most importantly, the cross section of flow area is not significantly reduced when the flow channel encounters the end caps 30, 32.

Figure 3:
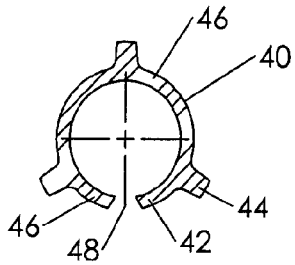
FIG. 3 is a cross section of an outer stator sleeve shown in FIG. 2 for positioning on the rotor sleeve shown in FIG. 1.

FIG. 3 illustrates a stator sleeve 40 which in normal operation surrounds the rotor sleeve and is positioned between the end surfaces 24. Stator sleeve 40 has an interior surface 42 for engaging the plurality of circumferentially spaced exterior surfaces 22 of the rotor sleeve, and has a plurality of ribs 44 each extending outward from the two or more outer cylindrical surface portions 46 of the stator sleeve. Surface 42 of the stator sleeve is a substantially cylindrical interior surface for sliding engagement with the plurality of external surfaces 22 on the rotor sleeve. The stator sleeve as shown in FIG. 3 has an elongate slot 48 which allows the generally C-shaped stator sleeve to be spread apart to be positioned on the rotor sleeve, with the material of the stator sleeve being such that the stator sleeve substantially resumes its prior configuration once positioned about the rotor sleeve and between the end stops 24.

Figure 4:
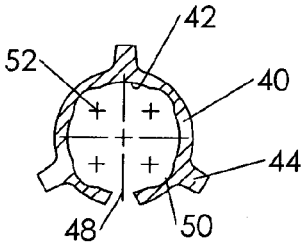
FIG. 4 is a cross section of an alternative stator sleeve for positioning on the rotor sleeve shown in FIG. 1.

FIG. 4 depicts an alternate embodiment of a rotor sleeve. In this case, the substantially cylindrical interior surface 42 is disrupted by providing a plurality of flow channels 50 which each extending radially outward from the otherwise cylindrical interior surface 42. Each of the flow channels 50 preferably extends from a lowermost end of the stator sleeve to an uppermost end of the stator sleeve, and preferably each cavity has an arcuate shaped interior surface. In that case, the center of the arc 52 is spaced radially inward of the inner cylindrical portion surface 42 of the stator sleeve. The arc may form a portion of a circle, or may form the surface of an ellipse other than a circle. The term "ellipse," as used herein, thus includes but is not limited to a circle. The stator sleeve as shown in FIG. 4 similarly has an elongate slot which is spread apart when the stator sleeve is positioned on the rotor sleeve. The combination of flow channels in the rotor sleeve, particularly when combined with the flow channels in the stator sleeve, increases the likelihood of sand or other debris passing by the rod guide without becoming trapped and causing an adverse effect on the useful life of the rod guide.

Figure 5:
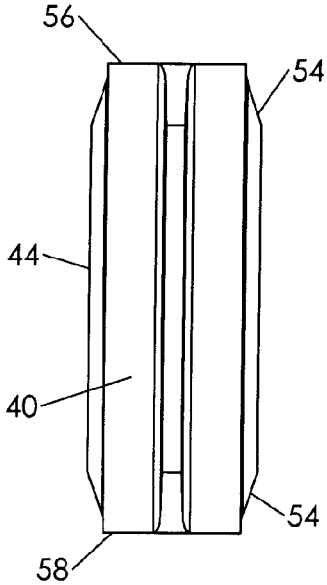
FIG. 5 is a side view of the stator sleeve generally shown in FIG. 4.

FIG. 5 depicts more clearly the stator sleeve 40 shown in FIG. 3. The ends of the fins or ribs 44 may be tapered, as shown by tapered portions 54. Also, the end surface 56 is designed to be positioned slightly below the upper stop surface 24, and similarly the end surface 58 is designed to be slightly above the lower stop surface 24, such that the stator sleeve has limited axial movement as the rotor sleeve rotates in response to the sucker rod.

The embodiment as disclosed herein contains a stator sleeve with three ribs, although two or more ribs may be used, so that one or two ribs would normally engage the interior surface of production tubing. While the size of flow channels 26 is significantly less than the cross sectional flow area exterior of the stator sleeve 40 and between the fins or ribs 44, substantial flow through the channels 26 occurs, and most importantly this flow tends to minimize accumulated sand or other debris from between the stator sleeve and the rotor sleeve, thereby prolonging the life of the guide.

It is a feature of the invention that the rotor sleeve includes two or more cylindrical surface portions, and form two or more flow channels between respective cylindrical surface portions. In many applications, three or more cylindrical surface portions are desired so that guiding forces may be distributed more uniformly about the circumference of the rotor. As previously suggested, the flow channels as disclosed herein may each form a portion of a circle, but in other applications the flow channels will each be defined by a substantially arcuate shaped interior surface on the rotor, with that surface being substantially similar to a portion of an ellipse. Sharp corners in the flow channels are desirably avoided.

Although specific embodiments of the invention have been described herein in some detail, this has been done solely for the purposes of explaining the various aspects of the invention, and is not intended to limit the scope of the invention as defined in the claims which follow. Those skilled in the art will understand that the embodiment shown and described is exemplary, and various other substitutions, alterations and modifications, including but not limited to those design alternatives specifically discussed herein, may be made in the practice of the invention without departing from its scope.

What is claimed is:

1. A rod guide for use on a rotating rod string for powering a progressive cavity pump for pumping downhole fluids to the surface, the rod guide comprising:

a rotor sleeve secured to the rod string, the rotor sleeve including a plurality of circumferentially spaced exterior surfaces each positioned substantially along an exterior of a cylinder having an axis aligned with an axis of the rod string;

the rotor sleeve having two stop surfaces for limiting axial movement of a stator sleeve with respect to the rotor sleeve, each of the plurality of exterior surfaces extending axially between the stop surfaces, the rotor sleeve having two or more axially extending cavities each radially inward of and spaced circumferentially between two of the exterior surfaces of the rotor sleeve, each cavity extending between the stop surfaces and passing axially through the stop surfaces for fluid flow between the rotor sleeve and the stator sleeve; and the stator sleeve surrounding the rotor sleeve and having an interior surface for engaging the plurality of circumferentially spaced exterior surfaces of the rotor sleeve, and having a plurality of ribs extending outward from two or more outer cylindrical surface portions of the stator sleeve, such that fluid passes between the outer cylindrical surface portions and a production tubing and between the plurality of ribs.

2. A rod guide as defined in claim 1, wherein the rotor sleeve is molded on the rod guide to secure the rotor sleeve to the rod string, and the rotor sleeve having a unitary construction.

3. A rod guide as defined in claim 1, wherein the two surfaces include an upper stop surface at a lower end of an upper stop member and a lower stop surface at an upper end of a lower stop member.

4. A rod guide as defined in claim 1, wherein a cross sectional flow area of each of the two or more axially extending cavities is substantially constant from an uppermost end of the rod guide to a lowermost end of the rod guide.

5. A rod guide as defined in claim 1, wherein a cross sectional flow area of the two or more axially extending cavities is defined in part by an arc of an ellipse having a centerpoint substantially aligned with the axis of the rotor sleeve.

6. A rod guide as defined in claim 5, wherein each of the two or more axially extending cavities defined by the arc of the ellipse have the centerpoint spaced substantially along the exterior of the cylinder.

7. A rod guide as defined in claim 1, wherein the stator sleeve is substantially C-shaped in cross section with an elongate slot opening to position the stator sleeve on the rotor sleeve.

8. A rod guide as defined in claim 1, wherein the stator sleeve has a substantially cylindrical interior surface for engagement with the plurality of exterior surfaces on the rotor sleeve.

9. A rod guide as defined in claim 1, wherein the stator sleeve has a plurality of axially extending flow channels spaced radially outward of and in fluid communication with a radially inner surface of the stator sleeve which engages the outer cylindrical surface portions.

10. A rod guide as defined in claim 9, wherein each of the flow channels in the stator sleeve has an arcuate cross section configuration, with a centerpoint of an ellipse spaced radially inward of the inner surface of the stator sleeve.

11. A rod guide for use on a rotating rod string for powering a progressive cavity pump for pumping downhole fluids to the surface, the rod guide comprising:

a rotor sleeve secured to the rod string, the rotor sleeve including a plurality of circumferentially spaced exterior surfaces each positioned substantially along an exterior of a cylinder having an axis aligned with an axis of the rod string;

the rotor sleeve having one or more stop surfaces for limiting axial movement of a stator sleeve with respect to the rotor sleeve, and having two or more axially extending cavities each radially inward of and spaced circumferentially between two of the exterior surfaces of the rotor sleeve, each of the plurality of exterior surfaces extending axially through the one or more stop surfaces, a cross sectional flow area of each of the two or more axially extending cavities is substantially constant from an uppermost end of the rod guide to a lowermost end of the rod guide, each cavity extending from the rotor sleeve and passing through the one or more stop surfaces for fluid flow between the rotor sleeve and the stator sleeve;

the stator sleeve being substantially C-shaped in cross section with an elongate slot opening to position the stator sleeve on the rotor sleeve, and having an interior surface for engaging the plurality of circumferentially spaced exterior surfaces of the rotor sleeve, and having a plurality of ribs extending outward from two or more outer cylindrical surface portions of the stator sleeve, such that fluid passes between the outer cylindrical surface portions and a production tubing and between the plurality of ribs.

12. A rod guide as defined in claim 11, wherein the rotor sleeve is molded on the rod guide to secure the rotor sleeve to the rod string, and the rotor sleeve having a unitary construction.

13. A rod guide as defined in claim 11, wherein the one or more stop surfaces include an upper stop surface at a lower end of an upper stop member and a lower stop surface at an upper end of a lower stop member.

14. A rod guide as defined in claim 11, wherein the cross sectional flow area of the two or more axially extending cavities is defined in part by an arc of a circle having a centerpoint substantially aligned with the axis of the rotor sleeve.

15. A rod guide as defined in claim 1, wherein the stator sleeve has a plurality of axially extending flow channels spaced radially outward of and in fluid communication with a radially inner surface on the stator sleeve.

16. A method of providing a rotating rod guide for use on a rotating rod string for powering a progressive cavity pump for pumping downhole fluids to the surface, the method comprising:

securing a rotor sleeve to the rod string, the rotor sleeve including a plurality of circumferentially spaced exterior surfaces each positioned substantially along an exterior of a cylinder having an axis aligned with an axis of the rod string;

providing one or more stop surfaces on the rotor sleeve for limiting axial movement of a stator sleeve with respect to the rotor sleeve, each of the plurality of exterior surfaces extending axially between the stop surfaces;

providing two or more axially extending cavities in the rotor sleeve each radially inward of and spaced circumferentially between two of the exterior surfaces of the rotor sleeve, each cavity extending from a bottommost surface to an opposing uppermost surface of the rotor sleeve and passing through the one or more stop surfaces for fluid flow between the rotor sleeve and the stator sleeve;

positioning the stator sleeve about the rotor sleeve, the stator sleeve having an interior surface for engaging the plurality of circumferentially spaced exterior surfaces of the rotor sleeve, and having a plurality of ribs extending outward from two or more outer cylindrical surface portions of the stator sleeve, such that fluid passes between the outer cylindrical surface portions and a production tubing and between the plurality of ribs; and rotating the rod string and the rotor sleeve to power the progressive cavity pump while pumping fluids through the production tubing surrounding the rod string and past the rod guide.

17. A method as defined in claim 16, wherein the rotor sleeve is molded on the rod guide to receive the rotor sleeve to the rod string, and the stator sleeve has a unitary construction.

18. A method as defined in claim 16, wherein a cross sectional flow area of each of the two or more axially extending cavities is substantially constant from an uppermost end of the rod guide to a lowermost end of the rod guide.

19. A rod guide as defined in claim 16, wherein the stator sleeve is substantially C-shaped in cross section with an elongate slot opening to position the stator sleeve on the rotor sleeve.

20. A rod guide as defined in claim 16, wherein the stator sleeve has a plurality of axially extending flow channels spaced radially outward of radially inner surface on the stator sleeve.

* * * * *